US007086135B2

(12) United States Patent
Kato

(10) Patent No.: US 7,086,135 B2
(45) Date of Patent: Aug. 8, 2006

(54) METHOD AND APPARATUS FOR MANUFACTURING GLOW PLUG

(75) Inventor: Hiroshi Kato, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 421 days.

(21) Appl. No.: 10/622,452

(22) Filed: Jul. 21, 2003

(65) Prior Publication Data

US 2004/0134064 A1 Jul. 15, 2004

(30) Foreign Application Priority Data

Jul. 19, 2002 (JP) ..... P. 2002-211348

(51) Int. Cl.
*B23P 19/02* (2006.01)

(52) U.S. Cl. ..... 29/525; 29/451; 29/611; 29/251

(58) Field of Classification Search ..... 29/251, 29/525, 451, 611, 613; 123/145 A, 169 R; 313/141; 219/205, 267, 270
See application file for complete search history.

(56) References Cited

U.S. PATENT DOCUMENTS

| | | | | |
|---|---|---|---|---|
| 4,620,511 A | * | 11/1986 | Brooks et al. | 123/145 A |
| 6,064,039 A | * | 5/2000 | Kumada | 219/270 |
| 2004/0188408 A1 | * | 9/2004 | Kumada et al. | 219/260 |

FOREIGN PATENT DOCUMENTS

| | | | |
|---|---|---|---|
| EP | 903541 A2 | | 9/1998 |
| JP | 04-028922 | * | 1/1992 |
| JP | 11-94254 A | | 11/1999 |
| JP | 2002-106842 | * | 4/2002 |
| JP | 2002-115846 | * | 4/2002 |

* cited by examiner

*Primary Examiner*—Eric Compton
(74) *Attorney, Agent, or Firm*—Sughrue Mion, PLLC

(57) ABSTRACT

A method for manufacturing a glow plug, the glow plug comprising a cylindrical metal shell having an internal bore formed in an axial direction, and a heater tube adapted to be press-fitted from its rear end side into the internal bore and having a leading end closed, the method comprising the steps of: place a stopper abutting on the leading end; and applying an axial load between the stopper and the metal shell so as to start a clamping of a side of the heater tube through a support member and to start a press-fit of the heater tube in the metal shell and an apparatus for manufacturing the glow plug.

9 Claims, 4 Drawing Sheets

METHOD AND APPARATUS FOR MANUFACTURING GLOW PLUG

TECHNICAL FIELD OF THE INVENTION

The present invention relates to a method for manufacturing a glow plug and an apparatus for manufacturing the glow plug.

BACKGROUND OF THE INVENTION

In the glow plug of the prior art, as shown in FIG. 4, a heater tube 2 and a metal shell are jointed to each other by press-fitting the former in the latter. Specifically, the heater tube 2 is set in a metal shell 4 having an internal bore 4*a*, and the heater tube 2 is inserted so far into a recessed holding portion 001*a* formed in a holding tool 001 that the closed leading end face of the heater tube 2 abuts against the holding portion 001*a*. Then, the heater tube 2 is press-fitted by applying an axial load to the holding tool 001 by a hydraulic press or the like.

As disclosed in JP-A-11-94254, on the other hand, the a press-fitting load is applied to the heater tube to press-fit its portion in the fitting portion formed in the internal bore of a housing, by clamping the outer circumference of the heater tube with a recessed collet and by pressing the collet.

However, the heater tube to be used in the glow plug is generally swaged so that its external diameter is easily dispersed according to the working condition. Moreover, the internal diameter of the fitting portion, which is formed in the internal bore of the metal shell to press-fit the press-fitted portion of the heater tube, is also easily dispersed according to the cutting condition or the like. As a result, the load necessary for the press-fit is also dispersed. In case the press-fit is done by the method shown in FIG. 4, therefore, the heater tube 2 may be bent (as will also be called "buckled"). After press-fitted, therefore, the heater tube 2 may be unable to be removed (as will also be called "bitten by") from the holding portion 001*a* of the holding tool 001.

On the other hand, a method disclosed in JP-A-11-94254 can inhibit the buckling to some extent but is insufficient for coping with the dispersion in the load necessary for the aforementioned press-fit. As a result, a high pressure is applied to the side face of the heater tube. Therefore, the side face of the heater tube is highly probably collapsed, deformed and damaged so that the oil in the heater tube is short-circuited to raise a problem that the internal resistance is changed.

Therefore, the dispersion in the external diameter of the heater tube is inhibited by cutting or grinding the heater tube. However, there arises another problem that the working steps increase and become troublesome.

SUMMARY OF THE INVENTION

An object of the present invention is to provide a method for manufacturing a glow plug of a high quality, which can cope with the dispersion in the press-fitting load while inhibiting the deformation of a heater tube, and an apparatus for the method.

According to a first aspect of the invention, there is provided a method for manufacturing a glow plug including a cylindrical metal shell having an internal bore formed in the axial direction, and a heater tube adapted to be press-fitted from its rear end side into the internal bore and having a leading end closed, wherein an axial load is applied between a stopper and the metal shell with the stopper abutting against the leading end face of the heater tube, thereby to start the clamping of the side of the heater tube through a support member and to start the press-fit of the heater tube in the metal shell.

In this manufacturing method, the stopper transmits the axial load to the heater tube while abutting against the leading end face of the heater tube. At this time, the heater tube is supported by pausing the axial load to act in the direction to shrink the support member, so that its side face is clamped by the support member. It is, therefore, possible to inhibit the buckling and bite, as might otherwise be caused by the axial load. As a result, the buckling or bite can be eliminated even with a high axial load, to relax the management of the diameter of the press-fitted portion of the heater tube.

In the manufacturing method of the invention, moreover, the press-fit of the heater tube into the metal shell is started by applying a higher axial load than the force to hold the support member thereby to bring the stopper into abutment against the leading end face of the heater tube. Unlike the disclosure of JP-A-11-94254, therefore, the support member need not intensely abut against the heater tube when the axial load is high. It is, therefore, possible to inhibit the deformation or damage of the side circumference of the heater tube.

Here, the support member may be formed a curved support face to clamp the heater tube. This is because the area to contact with the cylindrical heater tube can be made larger than the support face of the flat support face thereby to hardly make a deformation such as the collapse from the side face.

In the glow plug manufacturing method according to a second aspect of the invention, the support member is caused to apply the clamping force to clamp the heater tube, when the axial load is applied, and to relax the clamping force of the heater tube when the axial load is relaxed.

According to this manufacturing method, the clamping of the heater tube, the press-fit in the metal shell and the relaxing of the clamping of the heater tube can be done continuously in the single action to apply the axial load between the stopper and the metal shell. As compared with the prior art, therefore, the number of steps can be reduced to shorten the time period for the press-fitting step.

In the glow plug manufacturing method according to the first and second aspects, preferably, the heater tube includes a press-fitted portion formed on the rear end side and adapted to be press-fitted into the internal bore, and a diametrically reduced portion having a smaller diameter than that of the press-fitted portion and adapted to be at least partially clamped by the support member (a third aspect of the invention).

In recent years, the Diesel engine is intended to increase the number of valves and to lighten the parts, so that the engine space is narrowed at the portions, to which the glow plugs are attached. Accordingly, the glow plug is demanded to reduce its diameter. For this demand, the heater tube is made thick at its press-fitted portion but thin toward the leading end side. In other words, the load necessary for press-fitting the thick portion has to be supported by the diametrically reduced thin portion on the leading end side so that the buckling becomes more liable to occur. Like this manufacturing method, therefore, the buckling can be effectively inhibited by clamping the diametrically reduced portion, which might otherwise be buckled.

In the glow plug manufacturing method according to any of the aspects 1 to 3, preferably, that contact portion of the stopper, which is to abut against the leading end face of the heater tube, is shaped according to the shape of the leading end portion of the heater tube (a fourth aspect of the invention).

By this manufacturing method, the area of the contact face between the heater tube leading end portion and the stopper can be made larger than that of the application of the stopper having the flat contact face. As a result, the pressure to be applied to the heater tube leading end portion can be dispersed to prevent the deformation of the heater tube leading end.

According to a fifth aspect of the invention, there is provided an apparatus for manufacturing a glow plug including a cylindrical metal shell having an internal bore formed in the axial direction, and a heater tube adapted to be press-fitted from its rear end side into the internal bore and having a leading end closed, comprising:

a stopper for starting the press-fit, when an axial load is thereto, while abutting against the leading end face of the heater tube; and a support member having a face for clamping a side face of the heater tub, wherein the support member starts the clamping before the press-fit starts, when an axial load is applied to the stopper. The axial load necessary to start the press-fit is preferably higher than that necessary to start the clamping.

When the heater tube is press-fitted in the internal bore of the metal shell, according to the manufacturing apparatus, it is possible to inhibit the buckling and bite, as might otherwise be caused by the axial load. As a result, the buckling or bite can be eliminated even with a high axial load, to relax the management of the diameter of the press-fitted portion of the heater tube.

According to a sixth aspect of the invention, the glow plug manufacturing apparatus according to the fifth aspect further comprises: a taper collet for clamping the support member radially inward when the axial load is applied; and an engaging portion 7 surrounding the stopper for engaging, when the axial load is applied, with the taper collet to apply the radially inward clamping force to the taper collet.

When the axial load is applied, according to the manufacturing apparatus, the taper collet and the engaging portion come into engagement so that the taper collet is diametrically reduced. As a result, the taper collet clamps the support member, and the heater tube is clamped by the support member, so that the buckling or bite of the heater tube can be inhibited. When the axial load is relaxed, the clamping of the heater tube is relaxed so that the heater tube is released from the clamping by the support member. This makes it easy to remove the heater tube. Another effect is that such a small bend in the heater tube leading end from the center of the internal bore of the metal shell as would cause, if any, the bent at the press-fitting time, can be corrected by the clamping of the support member.

According to a seventh aspect of the invention, the glow plug manufacturing apparatus according to the sixth aspect further comprising a spring adapted to be compressed, when the engaging portion and the taper collet are brought into engagement by applying the axial load, for releasing the engagement when the axial load is relaxed.

According to this manufacturing apparatus, the spring, which has been compressed at the press-fitting time, is elongated promptly as the press-fitting load is relaxed at the press-fitting time, thereby to weaken the pressure of the support member on the heater tube side face, so that the manufacture can be done more quickly than the jig having no spring.

DESCRIPTION OF REFERENCE NUMERALS AND SIGNS

100 GLOW PLUG
200 PRESS-FITTING JIG
2 HEATER TUBE
4 METAL SHELL
5 SUPPORT MEMBER
6 TAPER COLLET
7 ENGAGING PORTION
8 SPRING
9 STOPPER
2*a* DIAMETRICALLY REDUCED PORTION
2*b* PRESS-FITTED PORTION
4*a* INTERNAL BORE

DETAILED DESCRIPTION OF THE INVENTION

Figure 1:
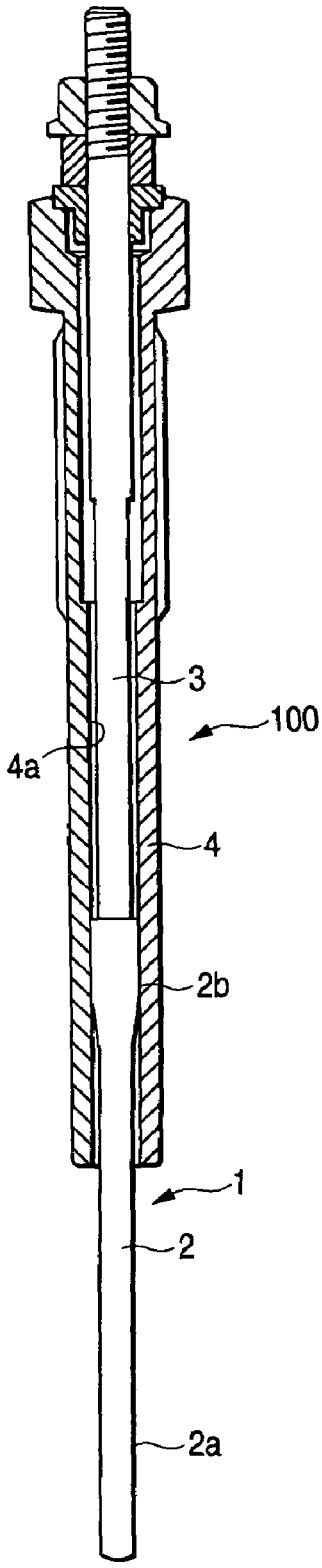
FIG. 1 is a sectional view of a glow plug to be manufactured in the present invention.

FIG. 1 is a longitudinal section showing on embodiment of a glow plug to be manufactured in the present invention. A glow plug 100 is provided with: a cylindrical metal shell 4, which has an internal bore 4*a* formed to extend in the axial direction of the glow plug 100; and a sheathed heater 1, which is so arranged in the internal bore 4*a* of the metal shell 4 as to protrude from the leading end face of the metal shell 4 in the axial direction. This sheathed heater 1 has a (not-shown) heating resistor therein. There are integrated in the axial direction: a heater tube 2, in which one end of the heating resistor is welded to the closed leading end face; and a conductive terminal core 3, which is connected with the other end of the heating resistor in that heater tube 2. This heater tube 2 is composed of: a press-fitted portion 2*b* to be press-fitted in the internal bore 4*a* of the metal shell 4, and a diametrically reduced portion 2*a*, which is so formed over a predetermined distance from that press-fitted portion 2*b* to the leading end side that its external diameter is made smaller than that of the press-fitted portion 2*b*.

In the present embodiment, the upward direction will be so defined on the axis of the glow plug 100 as is directed from the leading end side, in which the closed leading end face of the heater tube 2 exists, to the conductive terminal core 3, and the reverse direction will be defined as the downward direction.

Figure 2:
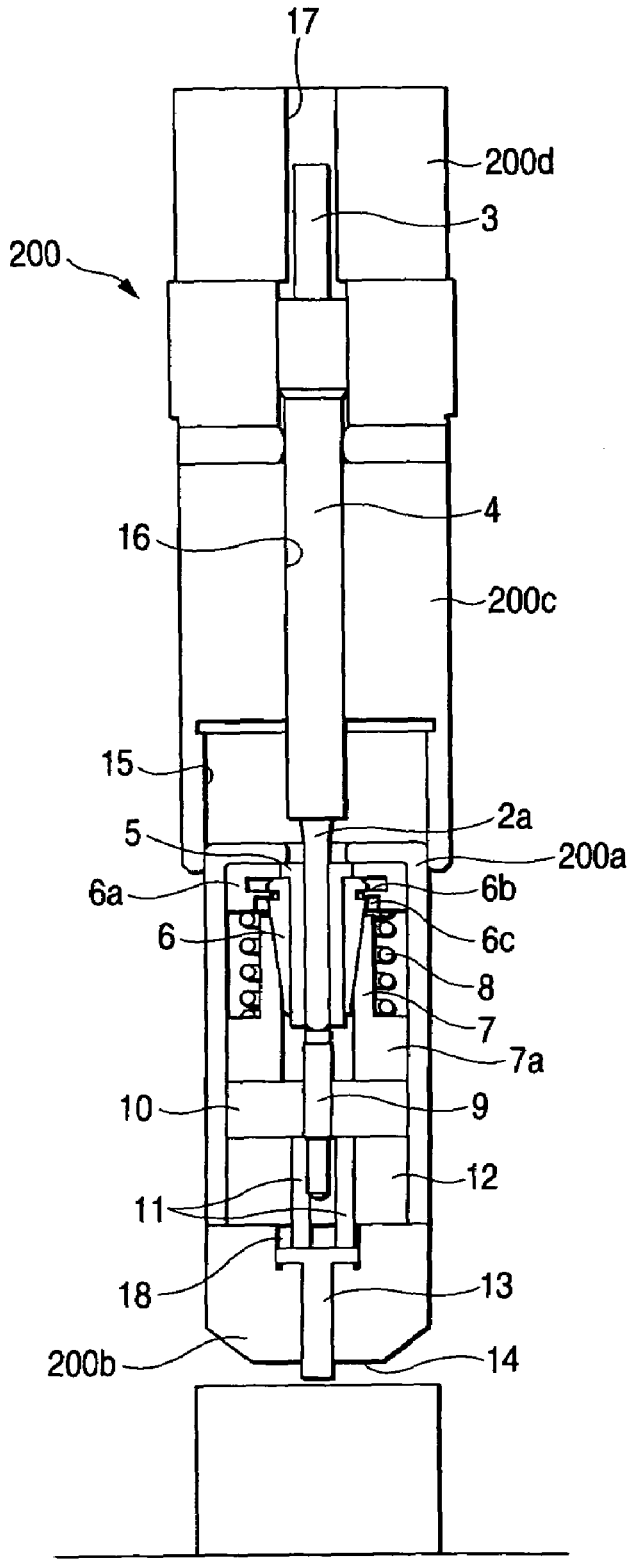
FIG. 2 is a diagram showing one embodiment of the invention at the time when a cylindrical part is set in a jig.

FIG. 2 shows a section of a jig 200 to be used in the embodiment of a glow plug manufacturing method according to the invention. The jig 200 to be used in the embodiment is constructed of a cover member 200*a*, a pedestal 200*b*, a hollow cylindrical member 200*c* and an inhibit member 200*d*. The cover member 200*a* is provided with: a three-piece hollow column-shaped support member 5 for clamping the diametrically reduced portion 2*a*; and a stopper for press-fitting the heater tube 2. The support member 5 has an internal diameter substantially equal to the external diameter of the diametrically reduced portion 2*a* of the heater tube 2 so that it may apply a force sufficient for clamping that diametrically reduced portion 2*a*. Moreover, that portion of the stopper 9, against which the leading end face of the heater tube 2 abuts, is rounded according to the shape of the leading end face of the heater tube 2. Therefore, the area of the contacting portion is enlarged to disperse the press-fitting load thereby to inhibit the deformation of the leading end portion of the heater tube 2.

The support 5 has its circumference side face enclosed by a taper collet 6. Against the upper face of this taper collet 6, there is arranged to abut a recessed taper collet cover 6*a*, which is opened on the lower side. This taper collet cover 6*a* has a larger internal diameter than the external diameter of the upper end portion of the taper collet 6, and is provided with a protrusion 6*b* on the radially inner side. The taper collet 6 is further provided with a cutout portion 6*c*. With the engagement between the protrusion 6*b* and the cutout portion 6*c*, moreover, the taper collet 6 is prevented from moving in the axial direction.

Around the stopper 9, on the other hand, there is disposed a plate-shaped part 10, which can move upward and downward using the stopper 9 as a center pin. On the upper face of the plate-shaped part 10, moreover, there is disposed an engaging portion 7, which has a taper face to contact with the taper face of the taper collet 6. From the lower end side of the engaging portion 7, there protrudes an engaging portion flanged portion 7*a* at a right angle with respect to the axis. A spring 8 is arranged between the flanged portion 7*a* and the taper collet cover 6*a*.

On the lower side of the plate-shaped part 10, on the other hand, there is disposed an intermediate plate part 12 having a bore, in which the lower portion of the stopper 9 is inserted and fixed and through which a later-described rod-shaped part 11 extends. The rod-shaped part 11 of a spindle shape contacts at its upper end with the lower face of the plate-shaped part 10 and at its lower end with a flanged pin 13 having a T-shaped axial section. This pin 13 is surrounded by the pedestal 200*b* and abuts at its upper face against the lower face of the intermediate plate part 12. Moreover, the flanged portion of the pin 13 is housed in a pedestal recess 18, which is formed in the pedestal 200*b*. On the other hand, the lower end of the pin 13 protrudes from the lower end face 14 of the pedestal 200*b*. The extent of protrusion is set shorter than the distance between the upper end face of the pedestal 200*b* and the upper end face of the pin 13, so that the upper end face of the pin 13 does not protrude from the upper end face of the pedestal 200*b* even when the lower end face of the pin 13 becomes flush with the lower end face 14 of the pedestal 200*b*.

On the upper face side of the pedestal 200*b*, moreover, there is fixed the cover member 200*a* having an upper plate inner face, against which the upper face of the taper collet cover 6*a* abuts. On the other hand, the internal diameter of the cover member 200*a* is made substantially equal to the individual external diameters of the taper collet cover 6*a*, the engaging portion flanged portion 7*a*, the plate-shaped part 10 and the intermediate plate part 12, thereby to prevent movements perpendicular to the axis.

Over the cover member 200*a*, there is arranged the hollow cylindrical member 200*c*, which has a recess on the lower side and a through bore 16 in the axial direction. The circumference of the upper portion of the cover member 200*a* contacts with the inner face 15 of the recess of the hollow cylindrical member 200*c*. The internal diameter of the through bore 16 of the hollow cylindrical member 200*c* is substantially equal to the external diameter of the metal shell 4, thereby to prevent the metal shell 4 from moving perpendicularly of the axis.

On the upper end face of the hollow cylindrical member 200*c*, moreover, there is arranged the inhibit member 200*d*. This inhibit member 200*d* has a though bore 17 formed in the axial direction, and the conductive terminal core 3 is inserted in the through bore 17. This through bore 17 of the inhibit member 200*d* has a smaller internal diameter than that of the contour of the rear end terminal of the metal shell 4. Moreover, the inhibit member 200*d* has a larger thickness than the protrusion length of the conductive terminal core 3, after inserted, from the rear end of the metal shell 4.

A temporary assembly is made by inserting the rear end portion of the sheathed heater 1 from leading end of the metal shell 4 into the internal bore 4*a*. The glow plug 100 thus temporarily assembled is inserted so far into the through bore 16 of the hollow cylindrical member 200*c* that the heater tube 2 comes into contact with the stopper 9. After this, the inhibit member 200*d* is arranged on the upper end face of the hollow cylindrical member 200*c*.

Figure 3:
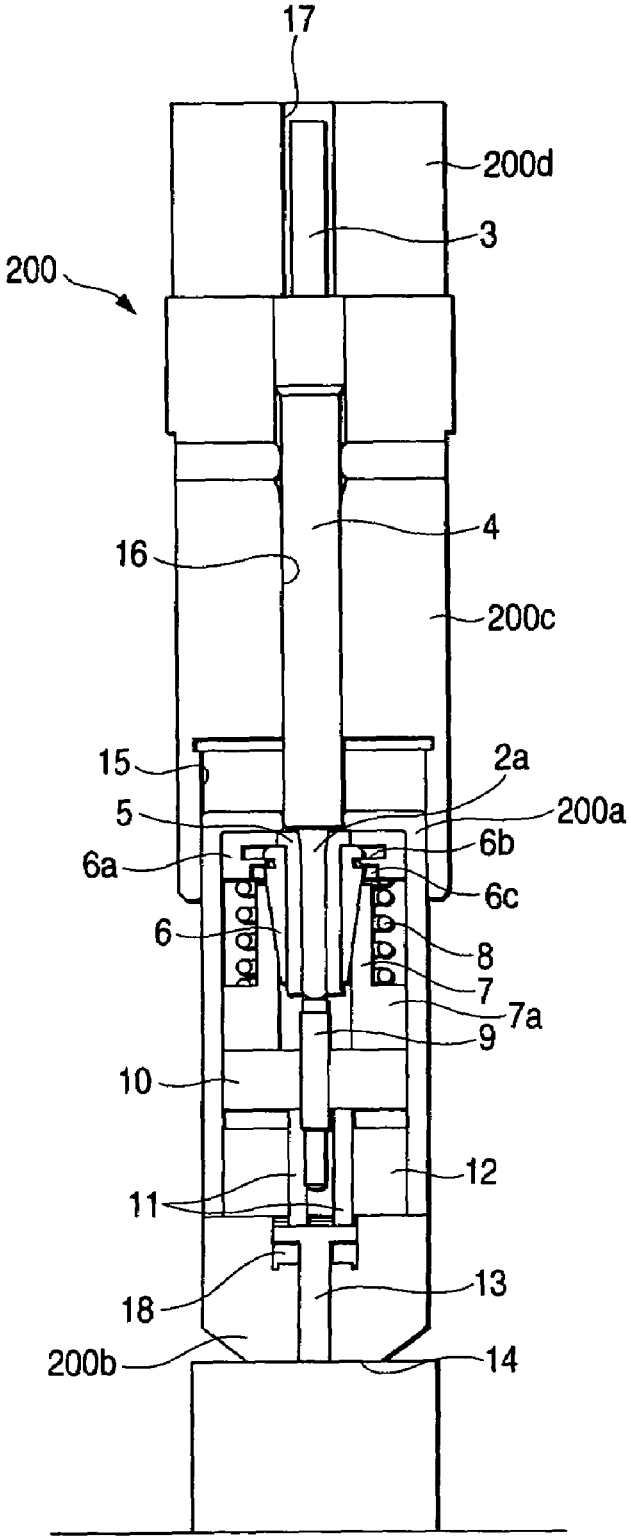
FIG. 3 is a diagram showing the embodiment of the invention at the time when a cylindrical part is press-fitted in a mounting part.
Figure 4:
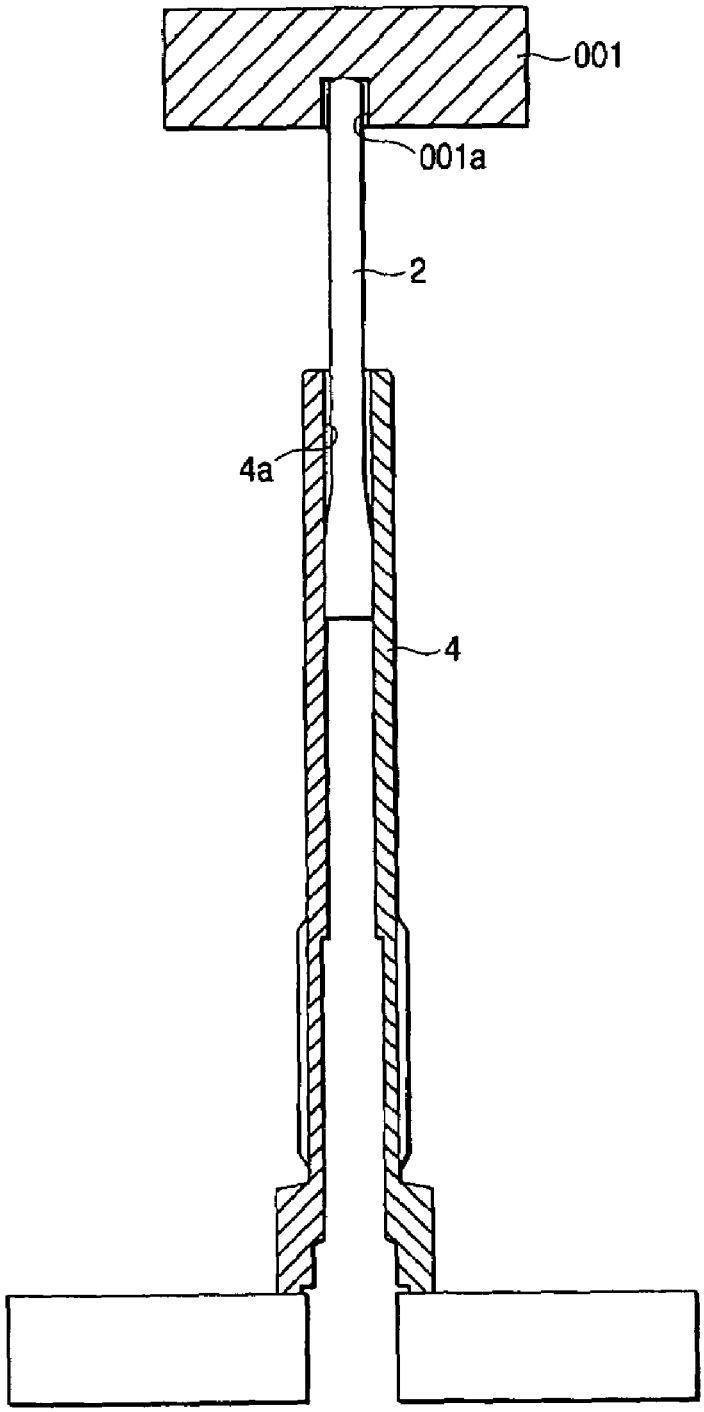
FIG. 4 PRIOR ART
FIG. 4 is an explanatory diagram showing a step to press-fit a heater tube in an external cylinder in an example of the prior art.

Here will be described acting state of the jig 200 thus far described. An axial load (or a first load: 30 to 100 Kg) is applied by a hydraulic press or the like between the upper end face of the inhibit member 200*d* and the lower end of the pin 13. Then, the clamp of the side face of the heater tube 2 by the support member 5 is started in the following procedure. As shown in FIG. 3, the lower end of the pin 13 becomes flush with the lower end face 14 of the pedestal 200*b*. According to this, the rod-shaped portion 11 abutting against the upper face of the pin 13 is raised. As this rod-shaped portion 11 rises, the plate-shaped part 10 abutting against the lower face is lifted, and the engaging portion 7 mounted on the upper face of the plate-shaped part 10 is also raised.

On the contrary, the taper collet 6 abutting against the taper face formed on the engaging portion 7 is inhibited from moving upward by the cover member 200*a*. As the engaging portion 7 moves upward, therefore, the taper collet 6 comes into the engaging portion 7. At this time, the taper collet 6 is shrunk radially inward by the interactions between the taper faces of the two. And, the shrunk taper collet 6 clamps the support member 5, and this support member 5 clamps the diametrically reduced portion 2*a* of the heater tube 2 radially inward. As the taper collet 6 comes into the engaging portion 7, moreover, the spring 8 disposed around the engaging portion 7 is compressed in the axial direction.

Here, the force for the support member 5 to clamp the diametrically reduced portion 2*a* of the heater tube 2 is generated by the insertion of the leading end of the pin into the lower end face 14 of the pedestal 200*b*. Therefore, the force to be applied to the side face of the heater tube 2 by the support member 5 becomes the maximum when the leading end of the pin 13 is flush with the lower end face 14 of the pedestal 200*b*. By adjusting the length of the pin 13 and the internal diameter of the taper collet 6, therefore, the maximum of the force for the support member 5 to abut against the side face of the heater tube 2 can be adjusted to inhibit the deformation or damage of the heater tube 2.

With the leading end of the pin 13 being flush with the lower end face 14 of the pedestal 200*b*, an axial load (or a second load: 150 to 400 Kg) is applied between the inhibit member 200*d* and the lower end face 14 of the pedestal 200*b*. As a result, there is started the press-fitting operation of the heater tube 2 having its leading end positioned by the stopper 9 into the internal bore 4*a* of the metal shell 4. At this time, a buckling of the heater tube 2 may occur. However, this failure such as buckling or deformation of the heater tube 2 can be inhibited because the diametrically reduced portion 2*a*, as might otherwise easily buckle, of the heater tube 2 is clamped by the support member 5.

As the axial load is released after the end of the press-fitting operation, moreover, the taper collet cover 6*a* and the engaging portion flanged portion 7*a* are disengaged. The taper collet 6 is chucked by its cover 6*a* so that it is disengaged from the engaging portion 7 when the spring restores its original state. Therefore, the pressure to clamp the support member 5 by the taper collet 6 is relaxed to relax the clamping pressure of the heater tube 2 by the support member 5 so that the heater tube 2 is released from the support member 5. Therefore, the support member 5 is thus released from its clamped state by making use of the elastic force of the spring 8 so that the glow plug 100 having the heater tube 2 press-fitted in the metal shell 4 can be easily extracted from the jig 200.

Thus, according to the glow plug manufacturing method according to the embodiment, by increasing the axial load, it is enabled to sequentially perform a series of operations: ① to start the proper clamping (or protection) of the heater tube by the support member; and ② to press-fit the heater tube in the metal shell. By reducing the axial load, moreover, it is enabled ③ to release the heater tube from the support member. In the procedure to increase the axial load, more specifically, the individual steps are started at the instants when the predetermined axial loads (i.e., the first and second axial loads) are reached. After the end of the operations, the axial loads are reduced so that the glow plug is released from the apparatus. By these simple operations to increase/decrease the axial loads, therefore, the heater tube can be press-fitted in the metal shell.

As the area for the support member 5 to contact with the heater tube 2 is the larger, it is the more preferable to prevent the deformation or damage. In the embodiment, however, the heater tube 2 can be inhibited from being deformed or damaged, by making a contact of 70% or more of the circumference of the diametrically reduced portion 2*a* on the leading end side of the heater tube 2.

This application is based on Japanese Patent application JP 2002-211348, filed Jul. 19, 2002, the entire content of which is hereby incorporated by reference, the same as if set forth at length.

What is claimed is:

1. A method for manufacturing a glow plug, the glow plug comprising a cylindrical metal shell having an internal bore formed in an axial direction, and a heater tube adapted to be press-fitted from its rear end side into the internal bore and having a leading end closed, the method comprising the steps of:

place a stopper abutting on the leading end; and applying an axial load between the stopper and the metal shell so as to start a clamping of a side of the heater tube through a support member and to start a press-fit of the heater tube in the metal shell.

2. The method according to claim 1, the applying step comprises:

applying a first axial load between the stopper and the metal shell so as to start the clamping of a side of the heater tube through a support member; and applying a second axial load higher than the first axial load so as to start the press-fit of the heater tube into the metal shell.

3. The method according to claim 1, wherein the support member is caused to apply a clamping force to clamp the heater tube, when the axial load is applied, and to relax the clamping force to the heater tube when the axial load is relaxed.

4. The method according to claim 1, wherein the heater tube comprises a press-fitted portion formed on the rear end side and adapted to be press-fitted into the internal bore, and a diametrically reduced portion having a smaller diameter than that of the press-fitted portion and adapted to be at least partially clamped by the support member.

5. The method according to claim 1, wherein a contact portion of the stopper, which is to abut on the leading end, is shaped according to a shape of the leading end.

6. An apparatus for manufacturing a glow plug, the apparatus comprising:

a cylindrical metal shell having an internal bore formed in an axial direction;

a heater tube adapted to be press-fitted from its rear end side into the internal bore and having a leading end closed;

a stopper for starting the press-fit, when an axial load is thereto, while abutting on the leading end; and a support member having a face for clamping a side face of the heater tube, wherein the support member starts the clamping before the press-fit starts, when an axial load is applied to the stopper.

7. The apparatus according to claim 6, wherein the axial load necessary to start the press-fit is higher than the axial load necessary to start the clamping.

8. The apparatus according to claim 6, further comprising:

a taper collet for clamping the support member radially inward when the axial load is applied; and an engaging portion surrounding the stopper for engaging, when the axial load is applied, with the taper collet so as to apply the radially inward clamping force to the taper collet.

9. The apparatus according to claim 8, further comprising a spring adapted to be compressed, when the engaging portion and the taper collet are brought into engagement by applying the axial load, for releasing the engagement when the axial load is relaxed.

* * * * *